US005858945A

United States Patent [19]

Lang et al.

[11] Patent Number: 5,858,945

[45] **Date of Patent: *Jan. 12, 1999**

[54] PERACID GRANULES CONTAINING CITRIC ACID MONOHYDRATE FOR IMPROVED DISSOLUTION RATES

[75] Inventors: David John Lang, Ossining, N.Y.; Duane Anthony Raible, Park Ridge, N.J.; Charles Vincent Sabatino, Bayside, N.Y.

[73] Assignee: Lever Brothers Company, Division of Conopco, Inc., New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 672,464

[22] Filed: Jun. 26, 1996

[51] Int. Cl.[6] ..... C11D 7/54; C11D 17/06

[52] U.S. Cl. ..... 510/224; 510/375; 510/444; 252/186.25; 252/186.26

[58] Field of Search ..... 252/186.25, 186.26; 510/229, 224, 372, 375, 477, 310, 444

[56] References Cited

U.S. PATENT DOCUMENTS

| | | | |
|---|---|---|---|
| 3,770,816 | 11/1973 | Nielsen | 562/3 |
| 3,968,048 | 7/1976 | Bolan | 510/375 |
| 4,100,095 | 7/1978 | Hutchins et al. | 510/310 |
| 4,126,573 | 11/1978 | Johnston | 510/310 |
| 4,455,249 | 6/1984 | Broze et al. | 510/307 |
| 4,686,063 | 8/1987 | Burns | 510/375 |
| 4,865,759 | 9/1989 | Coyne et al. | 510/310 |
| 5,229,028 | 7/1993 | Boutique et al. | 510/424 |
| 5,279,757 | 1/1994 | Gethoffer et al. | 510/310 |
| 5,411,673 | 5/1995 | Agar et al. | 510/313 |
| 5,419,846 | 5/1995 | Jaekel et al. | 510/310 |
| 5,453,214 | 9/1995 | van der Berg et al. | 510/303 |
| 5,500,154 | 3/1996 | Bacon et al. | 510/352 |
| 5,503,765 | 4/1996 | Schepers et al. | 510/304 |

FOREIGN PATENT DOCUMENTS

| | | |
|---|---|---|
| 356 700 | 3/1990 | European Pat. Off. . |
| 356700 | 3/1990 | European Pat. Off. . |
| 2-255800 | 10/1990 | Japan . |

OTHER PUBLICATIONS

International Cosmetic Ingredient Dictionary, Fifth Edition, vol. 1, 1993*, p. 155, "Citric Acid" Entry.

*Primary Examiner*—Paul Lieberman
*Assistant Examiner*—Caroline D. Liott
*Attorney, Agent, or Firm*—Neil Y. Gilbert; A. Kate Huffman

[57] ABSTRACT

The invention pertains to granules which incorporate citric acid monohydrate as an exotherm control agent within a peracid containing core. The granules have improved dissolution rates of the peracid in a dishwashing cycle. Compositions containing the granules are also described.

16 Claims, No Drawings

PERACID GRANULES CONTAINING CITRIC ACID MONOHYDRATE FOR IMPROVED DISSOLUTION RATES

FIELD OF THE INVENTION

The invention relates to granules which incorporate citric acid monohydrate as an exotherm control agent within a peracid containing core for improved dissolution rates of the peracid from the core in a washing cycle.

BACKGROUND OF THE INVENTION

Peracid bleaching agents have become an important alternative to chlorine or bromine bleaching agents in automatic dishwashing formulations. However, the pure form of many of these peracid bleaches may be insufficiently stable to be formulated without cogranulating the bleaches with an exotherm control agent. (See U.S. Pat. No. 4,100,095 (P&G)). These exothermic control materials absorb and dissipate any energy released from the peracid during slow decomposition at elevated temperatures and hinder any temperature rise of the cogranules. This prevents a runaway decomposition from occurring and eliminates the safety hazard at these temperatures.

Many of these agents are known and are reported in the literature. They consist of two types of compounds.

The first type consist of inorganic salt hydrates which release some of their waters of hydration at temperatures below the decomposition temperature of the peracid. These include hydrated materials such as magnesium sulfate, calcium sodium sulfate, magnesium nitrate, and aluminum sulfate (See Neilsen, U.S. Pat. No. 3,770,816). While these hydrated materials are able to supply water to quench the exothermic reaction, they suffer from several defects. These defects include:

1. The hydrated salts maintain sufficient vapor pressure of water in the presence of the peracid to increase the loss of available oxygen.

2. The loss of water to the surroundings due to high vapor pressure reduces the amount of exotherm control after lengthy storage periods.

3. Many of the hydrated salts contain high levels of metal ions which increase the loss of available oxygen during the storage and shelf life of the product and decrease the peracid performance in the wash solution.

The second type of exotherm control agent consists of nonhydrated compounds which decompose at temperatures below the decomposition temperature of the peracid to liberate water. These compounds provide the same exotherm control benefits of the hydrated salts while overcoming the aforementioned problems. Materials of this type include boric acid, malic acid, maleic acid, succinic acid, phthalic acid, and azelaic acid (See Hutchins et al., U.S. Pat. No. 4,100,095; and Burns, U.S. Pat. No. 4,686,063). Due to their acidic nature these compounds also create a slightly acidic environment for the peracid particles during storage which will lower hydrolysis rates and increase the stability of the peracid. A particularly useful material in this respect has been boric acid due to its high weight effectiveness.

Although all the materials in the aforementioned second group of compounds have been found to be effective as exotherm control agents, it has been observed that they decrease the effectiveness of the pure form of peracid bleaching agents. All of the compounds have rather low solubilities and dissolve slowly in the wash solution.

This results in a slow dissolution of the peracid granule which decreases the performance of the bleaching agent.

This lessened performance is particularly pronounced in colder temperatures and for coated granules which provide a delayed release of the peracid.

It has been found in the present invention that an improved exotherm control compound will provide improved dissolution and an acidic environment within the granule, be devoid of metal ions, and supply water at temperatures below the decomposition temperature of the peracid to control exothermic decomposition.

Accordingly, it is an object of the present invention to provide a composition containing a peracid compound having improved dissolution properties while maintaining good exothermic control.

As used herein, all percentages and ratios are by weight unless otherwise specified.

SUMMARY OF THE INVENTION

It is thus an object of the present invention to provide a granule composition comprising a peracid material and citric acid monohydrate as an exotherm control agent. These granules provide improved dissolution when compared to conventional nonhydrated exotherm control materials such as boric acid. They also contain no metal ions and provide an acidic environment for enhanced stability of the peracid in the granule. Surprisingly, these compositions provide exotherm control comparable to granules which utilize boric acid as the exotherm control agent.

In a second aspect, the invention comprises a process of making the peracid granules. The peracid material is agglomerated with the citric acid monohydrate in a ratio of 15:1 to 1:2 to form rapidly dissolving granules of the chosen particle size.

A third aspect of the invention comprises solid and liquid cleaning compositions which include 0.1% to 15% by weight of the peracid granules, 0.1% to 70% by weight of a builder, 0.1% to 30% by weight of a buffering agent and other conventional cleaning components.

DETAILED DESCRIPTION OF PREFERRED EMBODIMENTS

The granules of the invention combine an active peracid compound and citric acid monohydrate to improve dissolution rates. These materials are conventionally held together by a polymeric or inorganic binder material. The dissolution rate may be further improved by combining a selected surfactant into the granule.

Exotherm Control Compound

Citric acid monohydrate is the exotherm control agent useful in the invention due to the superior dissolution profile exhibited by the co-granules it forms with various peracid species. The citric acid monohydrate also provides a slightly acidic environment to enhance peracid stability during the storage and does not contain any destabilizing metal ions. The citric acid monohydrate also provides exotherm control capabilities to peracid co-granules at least comparable to peracid co-granules formulated with exotherm control agents which chemically decompose such as boric or malic acid. The citric acid slowly loses its water of hydration at moderately high temperatures of approximately 70°–75° C. At higher temperatures this rate becomes increasingly rapid. This action proportionately offsets and controls the rate of decomposition of the peracid at moderately high storage temperatures which might be encountered by a detergent composition in abuse conditions.

The citric acid monohydrate is present in the granule in a ratio of peracid compound to citric acid monohydrate of 1:2 to 15:1, preferably 3:1 to 10:1.

Peracid Compound

The oxygen bleaching agents of the compositions include organic peroxy acids and diacylperoxides. Typical monoperoxy acids useful herein include alkyl peroxy acids and aryl peroxy acids such as:

i) peroxybenzoic acid and ring-substituted peroxybenzoic acids, e.g., peroxy-alpha-naphthoicacid, and magnesium monoperoxyphthalate ii) aliphatic and substituted aliphatic monoperoxy acids, e.g., peroxylauric acid, epsilon-phthalimido-peroxyhexanoic acid and o-carboxybenzamido peroxyhexanoic acid, N-nonylamidoperadipic acid and N-nonylamidopersuccinic acid.

iii) Cationic peroxyacids such as those described in U.S. Pat. No. 5,422,028; 5,294,362; and 5,292,447; U.S. Ser. No. 08/738,504 filed Oct. 24, 1996 Oakes et al.; and U.S. Ser. No. 08/210,973, filed Mar. 21, 1994 Oakes et al., now U.S. Pat. No. 5,422,028, herein incorporated by reference.

iv) Sulfonyl peroxyacids such as compounds described in U.S. Pat. No. 5,039,447 (Monsanto Co.), herein incorporated by reference.

Typical diperoxy acids useful herein include alkyl diperoxy acids and aryl diperoxy acids, such as:

v) 1,12-diperoxydodecanedioic acid vi) 1,9-diperoxyazelaic acid vii) diperoxybrassylic acid; diperoxysecacic acid and diperoxyisophthalic acid viii) 2-decyldiperoxybutan-1,4-dioic acid ix) N,$N^1$-terephthaloyl-di(6-aminopercaproic acid).

A typical diacylperoxide useful herein includes dibenzoylperoxide.

Inorganic peroxygen compounds are also suitable for the present invention. Examples of these materials useful in the invention are salts of monopersulfate, perborate monohydrate, perborate tetrahydrate, and percarbonate.

Preferred oxygen bleaching agents include epsilon-phthalimido-peroxyhexanoic acid, o-carboxybenzaminoperoxyhexanoicacid, and mixtures thereof.

The oxygen bleaching agent is present in the composition in an amount from about of 1 to 20 weight percent, preferably 1 to 15 weight percent, most preferably 2 to 10 weight percent.

The oxygen bleaching agent may be incorporated directly into the formulation or may be encapsulated by any number of encapsulation techniques known in the art to produce stable capsules in alkaline liquid formulations.

A preferred encapsulation method is described in U.S. Pat. No. 5,200,236 issued to Lang et al., herein incorporated by reference. In the patented method, the bleaching agent is encapsulated as a core in a paraffin wax material having a melting point from about 40° C. to 50° C. The wax coating has a thickness of from 100 to 1500 microns.

Agglomerating the Peracid Granules

The peracid compound must be agglomerated with the citric acid monohydrate to form granules for use in the invention. There are several methods known in the art for producing such granules formed by agglomeration. Such methods include softening or melting an agglomerating agent and contacting the softened or molten agglomerating agent with the selected core material in a pan granulator, high shear granulator, rolling drum, a fluid bed, or a falling curtain spray-on.

A preferred preparation technique for this equipment is "wet granulation" where a solution of the agglomerating agent is sprayed onto a mixture of the citric acid monohydrate and peracid particles while drying the material to slowly build bridges of agglomerating agent between the materials and produce agglomerates of the preferred characteristics. In an optional preparation technique, the molten agglomerating agent having a melting temperature in the range from about 30° C. to 75° C. is sprayed onto the mixture of peracid species and citric acid monohydrate in a pan granulator.

In another preferred preparation technique, the agglomerated granules may be prepared in a high-speed mixer/granulator. The agglomerating agent must be stable and inert with respect to the active materials, should preferably not melt below 25° C., and must be completely soluble or dispersible in water or melt above 50° C. Suitable agglomerating agents and processing conditions are described in EP 0,390,287 corresponding to U.S. Ser. No. 07/495,548 filed on Mar. 19,1990, now abandoned, and Ser. No. 07/604,030, filed on Oct. 24, 1990, now U.S. Pat. No. 5,167,852 herein incorporated by reference.

Another approach for production of the peracid granules is to disperse the peracid species uniformly in the agglomerating agent. The mixture is heated slightly (remembering to keep the temperature well below the decomposition temperature of the peracid) so that it is in a soft or molten state so that the mixture becomes a uniform dough. This dough is then extruded with an axial or radial extruder to form noodles which are cut to form small pellets. The pellets are produced to have the desired characteristics. In an optional additional step, these pellets may be spheronized by a treatment in a machine known as a Marumerizer® instrument distributed by Luwa Corporation of Charlotte, N.C. This spheronizing method is described in U.S. Pat. No. 4,009,113 herein incorporated by reference.

Specific examples of agglomerating agents suitable for use with peracid bleaches as cited in this invention are disclosed in U.S. Pat. No. 4,087,369; U.S. Pat. No. 4,486,327; EP 0 376 360, U.S. Pat. No. 4,917,811, U.S. Pat. No. 4,713,079, U.S. Pat. No. 4,707,160, EP 0 320219, U.S. Pat. No. 4,917,813, and application Ser. No. 07/543,640, filed on Jun. 26, 1990 by Garcia et al., now U.S. Pat. No. 5,055,217 describing polymer protected bleach precursors herein incorporated by reference. The weight ratio of bleach to the agglomerating agent is normally in the range 1:2 to 50:1, preferably from 2:1 to 40:1. The granules composed of these agglomerated bleach particles are normally dosed into the final product formulation at levels from 0.1% to 10%.

Cleaning Compositions Incorporating Encapsulated Particles

The peracid granules of the invention may be incorporated into a variety of powder cleaning compositions such as automatic machine dishwashing, hard surface cleaners and fabric washing cleaners for both household and industrial use. They may also be used in liquid cleaning compositions for the same purposes provided that the granules are encapsulated with a suitable protective coating. Most of these compositions will contain from about 1–75% of a builder component and will also contain from about 0 to about 40% of a surfactant, preferably about 0.5% to about 20% by weight of the composition.

Other ingredients which may be present in the cleaning composition include cleaning enzymes, peracid precursors or bleach catalysts. Any one or more of these ingredients may also be encapsulated before adding them to the composition. If such ingredients are encapsulated they would be present in the following percentages by weight of the composition:

| | |
|---|---|
| enzyme | 0.1 to 5% |
| peracid precursor | 0.1 to 10% |
| bleach catalyst | 0.001 to 5% |
| peracid | 0.1 to 10% |

Automatic dishwashing detergent powders and liquids will usually have the compositions listed in Table I.

TABLE I

Automatic Dishwashing Detergent Compositions.

| | PERCENT BY WEIGHT | |
|---|---|---|
| COMPONENTS | POWDER FORMULATION | LIQUID FORMATION |
| Builder | 0–70 | 0–60 |
| Surfactant | 0–10 | 0–15 |
| Filler | 0–60 | — |
| Buffering Agent | 0.1–40 | 0.1–30 |
| Silicate | 0–40 | 0–30 |
| Bleaching Agent | 0–20 | 0–20 |
| Enzymes | 0–5 | 0–5 |
| Enzyme Stabilizing System | — | 0–15 |
| Antifoam | 0–2 | 0–2 |
| Bleaching Catalyst | 0–5 | 0–5 |
| Thickener | — | 0–5 |
| Bleach Scavenger | 0–5 | 0–5 |
| Perfume | 0–2 | 0–2 |
| Water | to 100 | to 100 |

Gels differ from liquids in that gels are primarily structured by polymeric materials and contain little or no clay.

Detergent Builder Materials

The cleaning compositions of this invention can contain all manner of detergent builders commonly taught for use in automatic dishwashing or other cleaning compositions. The builders can include any of the conventional inorganic and organic water-soluble builder salts, or mixtures thereof and may comprise 1 to 90%, and preferably, from about 5 to about 70% by weight of the cleaning composition.

Typical examples of phosphorus-containing inorganic builders, when present, include the water-soluble salts, especially alkali metal pyrophosphates, orthophosphates and polyphosphates. Specific examples of inorganic phosphate builders include sodium and potassium tripolyphosphates, phosphates, pyrophosphates and hexametaphosphates.

Suitable examples of non-phosphorus-containing inorganic builders, when present, include water-soluble alkali metal carbonates, bicarbonates, sesquicarbonates, borates, silicates, layered silicates, metasilicates, and crystalline and amorphous aluminosilicates. Specific examples include sodium carbonate (with or without calcite seeds), potassium carbonate, sodium and potassium bicarbonates, silicates and zeolites.

Particularly preferred inorganic builders can be selected from the group consisting of sodium tripolyphosphate, potassium tripolyphosphate, potassium pyrophosphate, sodium carbonate, potassium carbonate, sodium bicarbonate, sodium silicate and mixtures thereof. When present in these compositions, sodium and potassium tripolyphosphate concentrations will range from about 2% to about 60%; preferably from about 5% to about 50%. Sodium carbonate and bicarbonate when present can range from about 5% to about 50%; preferably from about 10% to about 30% by weight of the cleaning compositions. Sodium and potassium tripolyphosphate and potassium pyrophosphate are preferred builders in gel formulations, where they may be used at from about 3% to about 45%, preferably from about 10% to about 35%.

Organic detergent builders can also be used in the present invention. Examples of organic builders include alkali metal citrates, succinates, malonates, fatty acid sulfonates, fatty acid carboxylates, nitrilotriacetates, phytates, phosphonates, alkanehydroxyphosphonates, oxydisuccinates, alkyl and alkenyl disuccinates, oxydiacetates, carboxymethyloxy succinates, ethylenediamine tetracetates, tartrate monosuccinates, tartrate disuccinates, tartrate monoacetates, tartrate diacetates, oxidized starches, oxidized heteropolymeric polysaccharides, polyhydroxysulfonates, polycarboxylates such as polyacrylates, polymaleates, polyacetates, polyhydroxyacrylates, polyacrylate/polymaleate and polyacrylate/polymethacrylate copolymers, acrylate/maleate/vinyl alchohol terpolymers, aminopolycarboxylates and polyacetal carboxylates such as those described in U.S. Pat. Nos. 4,144,226 and 4,146,495.

Alkali metal citrates, oxydisuccinates, polyphosphonates and acrylated maleate copolymers and acrylate/maleate/vinyl alcohol terpolymers are especially preferred organic builders. When present they are preferably available from about 1% to about 45% of the total weight of the detergent compositions.

The foregoing detergent builders are meant to illustrate but not limit the types of builder that can be employed in the present invention.

Bleach Precursors

Suitable peroxygen peracid precursors for peroxy bleach compounds have been amply described in the literature, including GB Nos. 836,988; 855,735; 907,356; 907;358; 907,950; 1,003,310 and 1,246,339; U.S. Pat. Nos. 3,332,882 and 4,128,494.

Typical examples of precursors are polyacylated alkylene diamines, such as N,N,N$^1$, N$^1$-tetraacetylethylene diamine (TAED) and N,N,N$^1$, N$^1$-tetraacetylmethylene diamine (TAMD); acylated glycolurils, such as tetraacetylglycoluril (TAGU); triacetylcyanurate, sodium sulfophenyl ethyl carbonic acid ester, sodium acetyloxybenene sulfonate (SABS), sodium nonanoyloxy benzene sulfonate (SNOBS) and choline sulfophenyl carbonate. Peroxybenzoic acid precursors are known in the art, e.g., as described in GB-A-836,988. Examples of suitable precursors are phenylbenzoate; phenyl p-nitrobenzoate; o-nitrophenyl benzoate; o-carboxyphenyl benzoate; p-bromophenylbenzoate; sodium or potassium benzoyloxy benzenesulfonate; and benzoic anhydride.

Preferred peroxygen bleach precursors are sodium p-benzoyloxybenzene sulfonate, N,N,N$^1$,N$^1$-tetraacetylethylene diamine, sodium nonanoyloxybenzene sulfonate and choline sulfophenyl carbonate.

Anti-Scalants

Scale formation on dishes and machine parts is an important problem that needs to be resolved or at least mitigated in formulating a machine warewashing product, especially in the case of low-phosphate (e.g. less than the equivalent of 20% by weight, particularly 10% by weight of sodium triphosphate) and phosphate-free machine warewashing compositions, particularly zero-P machine warewashing compositions.

In order to reduce this problem, co-builders, such as polyacrylic acids or polyacrylates (PAA), acrylate/maleate copolymers, polyaspartates, ethylenediamine disuccinate and the various organic polyphosphonates, e.g. Dequest series, may be incorporated in one or more system components. For improved biodegradability, (as such co-builders), the block co-polymers of formula (I) as defined in published PCT patent specification WO 94/17170 may also be used. In any component, the amount of anti-scalant may be in the range of from 0.5 to 10, preferably from 0.5 to 5, and more preferably from 1 to 5% by weight.

Surfactants

Useful surfactants include anionic, nonionic, cationic, amphoteric, zwitterionic types and mixtures of these surface active agents. Such surfactants are well known in the detergent art and are described at length in "Surface Active Agents and Detergents", Vol. 11, by Schwartz, Perry & Birch, Interscience Publishers, Inc. 1959, herein incorporated by reference.

Preferred surfactants are one or a mixture of:

Anionic surfactants

Anionic synthetic detergents can be broadly described as surface active compounds with one or more negatively charged functional groups. An important class of anionic compounds are the water-soluble salts, particularly the alkali metal salts, of organic sulfur reaction products having in their molecular structure an alkyl radical containing from about 6 to 24 carbon atoms and a radical selected from the group consisting of sulfonic and sulfuric acid ester radicals.

Primary Alkyl Sulfates $$R^1OSO_3M$$

where $R^1$ is a primary alkyl group of 8 to 18 carbon atoms and M is a solubilizing cation. The alkyl group $R^1$ may have a mixture of chain lengths. It is preferred that at least two thirds of the $R^1$ alkyl groups have a chain length of 8 to 14 carbon atoms. This will be the case if $R^1$ is coconut alkyl, for example. The solubilizing cation may be a range of cations which are in general monovalent and confer water solubility. Alkali metal, notably sodium, is especially envisaged. Other possibilities are ammonium and substituted ammonium ions, such as trialkanolammonium or trialkylammonium.

Alkyl Ether Sulfates $$R^1O(CH_2CH_2O)_nSO_3M$$

where $R^1$ is a primary alkyl group of 8 to 18 carbon atoms, n has an average value in the range from 1 to 6 and M is a solubilizing cation. The alkyl group $R^1$ may have a mixture of chain lengths. It is preferred that at least two thirds of the $R^1$ alkyl groups have a chain length of 8 to 14 carbon atoms. This will be the case if $R^1$ is coconut alkyl, for example. Preferably n has an average value of 2 to 5.

Fatty Acid Ester Sulfonates $$R^2CH(SO_3M)\ CO_2R^3$$

where $R^2$ is an alkyl group of 6 to 16 atoms, $R^3$ is an alkyl group of 1 to 4 carbon atoms and M is a solubilizing cation. The group $R^2$ may have a mixture of chain lengths. Preferably at least two thirds of these groups have 6 to 12 carbon atoms.

This will be the case when the moiety $R^2CH(—)CO_2(—)$ is derived from a coconut source, for instance. It is preferred that $R^3$ is a straight chain alkyl, notably methyl or ethyl.

Alkyl Benzene Sulfonates $$R^4ArSO_3M$$

where $R^4$ is an alkyl group of 8 to 18 carbon atoms, Ar is a benzene ring ($C_6H_4$) and M is a solubilizing cation. The group $R^4$ may be a mixture of chain lengths. Straight chains of 11 to 14 carbon atoms are preferred.

Organic phosphate based anionic surfactants include organic phosphate esters such as complex mono- or diester phosphates of hydroxyl-terminated alkoxide condensates, or salts thereof. Included in the organic phosphate esters are phosphate ester derivatives of polyoxyalkylated alkylaryl phosphate esters, of ethoxylated linear alcohols and ethoxylates of phenol. Also included are nonionic alkoxylates having a sodium alkylenecarboxylate moiety linked to a terminal hydroxyl group of the nonionic through an ether bond. Counterions to the salts of all the foregoing may be those of alkali metal, alkaline earth metal, ammonium, alkanolammonium and alkylammonium types.

Particularly preferred anionic surfactants are the fatty acid ester sulfonates with formula:

$$R^2CH(SO_3M)\ CO_2R^3$$

where the moiety $R^2CH(-)CO_2(-)$ is derived from a coconut source and $R^3$ is either methyl or ethyl.

Nonionic surfactants

Nonionic surfactants can be broadly defined as surface active compounds with one or more uncharged hydrophilic substituents. A major class of nonionic surfactants are those compounds produced by the condensation of alkylene oxide groups with an organic hydrophobic material which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative, but not limiting examples, of various suitable nonionic surfactant types are:

polyoxyethylene or polyoxypropylene condensates of aliphatic carboxylic acids, whether linear- or branched-chain and unsaturated or saturated, containing from about 8 to about 18 carbon atoms in the aliphatic chain and incorporating from about 2 to about 50 ethylene oxide and/or propylene oxide units. Suitable carboxylic acids include "coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid, polyoxyethylene or polyoxypropylene condensates of aliphatic alcohols, whether linear- or branched-chain and unsaturated or saturated, containing from about 6 to about 24 carbon atoms and incorporating from about 2 to about 50 ethylene oxide and/or propylene oxide units. Suitable alcohols include "coconut" fatty alcohol, "tallow" fatty alcohol, lauryl alcohol, myristyl alcohol and oleyl alcohol.

Ethoxylated fatty alcohols may be used alone or in admixture with anionic surfactants, especially the preferred surfactants above. The average chain lengths of the alkyl group $R^5$ in the general formula:

$$R^5O(CH_2CH_2O)_nH$$

is from 6 to 20 carbon atoms. Notably the group $R^5$ may have chain lengths in a range from 9 to 18 carbon atoms.

The average value of n should be at least 2. The numbers of ethylene oxide residues may be a statistical distribution around the average value. However, as is known, the distribution can be affected by the manufacturing process or altered by fractionation after ethoxylation. Particularly preferred ethoxylated fatty alcohols have a group $R^5$ which has 9 to 18 carbon atoms while n is from 2 to 8.

Also included within this category are nonionic surfactants having a formula:

$$R^6-(CH_2\underset{\underset{R^7}{|}}{C}HO)_x(CH_2CH_2O)_y(CH_2\underset{\underset{R^8}{|}}{C}HO)_zH$$

wherein $R^6$ is a linear alkyl hydrocarbon radical having an average of 6 to 18 carbon atoms, $R^7$ and $R^8$ are each linear alkyl hydrocarbons of about 1 to about 4 carbon atoms, x is an integer of from 1 to 6, y is an integer of from 4 to 20 and z is an integer from 4 to 25.

One preferred nonionic surfactant of the above formula is Poly-Tergent SLF-18® a registered trademark of the Olin Corporation, New Haven, Conn. having a composition of the above formula where $R^6$ is a $C_6$–$C_{10}$ linear alkyl mixture, $R^7$ and $R^8$ are methyl, x averages 3, y averages 12 and z averages 16. Another preferred nonionic surfactant is $$R^9O(CH_2\underset{\underset{CH_3}{|}}{C}HO)_j(CH_2CH_2O)_k(CH_2CH(OH)R^{10})_l$$

wherein $R^9$ is a linear, aliphatic hydrocarbon radical having from about 4 to about 18 carbon atoms including mixtures thereof; and $R^{10}$ is a linear, aliphatic hydrocarbon radical having from about 2 to about 26 carbon atoms including mixtures thereof; j is an integer having a value of from 1 to about 3; k is an integer having a value from 5 to about 30; and z is an integer having a value of from 1 to about 3. Most preferred are compositions in which j is 1, k is from about 10 to about 20 and I is 1. These surfactants are described in WO 94/22800. Other preferred nonionic surfactants are linear fatty alcohol alkoxylates with a capped terminal group, as described in U.S. Pat. No. 4,340,766 to BASF.

Another nonionic surfactant included within this category are compounds of formula:

$$R^{11}-(CH_2CH_2O)_qH$$

wherein $R^{11}$ is a $C_6$–$C_{24}$ linear or branched alkyl hydrocarbon radical and q is a number from 2 to 50; more preferably $R^{11}$ is a $C_8$–$C_{18}$ linear alkyl mixture and q is a number from 2 to 15.

polyoxyethylene or polyoxypropylene condensates of alkyl phenols, whether linear- or branched-chain and unsaturated or saturated,containing from about 6 to 12 carbon atoms and incorporating from about 2 to about 25 moles of ethylene oxide and/or propylene oxide.

polyoxyethylene derivatives of sorbitan mono-, di-, and tri-fatty acid esters wherein the fatty acid component has between 12 and 24 carbon atoms. The preferred polyoxyethylene derivatives are of sorbitan monolaurate, sorbitan trilaurate, sorbitan monopalmitate, sorbitan tripalmitate, sorbitan monostearate, sorbitan monoisostearate, sorbitan tripalmitate, sorbitol tristearate, sorbitan monooleate, and sorbitan trioleate. The polyoxyethylene chains may contain between about 4 and 30 ethylene oxide units, preferably about 10 to 20. The sorbitan ester derivatives contain 1, 2 or 3 polyoxyethylene chains dependent upon whether they are mono-, di- or tri-acid esters.

polyoxyethylene-polyoxypropylene block copolymers having formula:

$$HO(CH_2CH_2O)_a(CH(CH_3)\ CH_2O)_b(CH_2CH_2O)_cH$$

or $$HO(CH(CH_3)CH_2O)_d(CH_2CH_2O)_e(CH(CH_3)CH_2O)_fH$$

wherein a, b, c, d, e and f are integers from 1 to 350 reflecting the respective polyethylene oxide and polypropylene oxide blocks of said polymer. The polyoxyethylene component of the block polymer constitutes at least about 10% of the block polymer. The material preferably has a molecular weight of between about 1,000 and 15,000, more preferably from about 1,500 to about 6,000. These materials are well-known in the art. They are available under the trademark "Pluronic" and "Pluronic R", a product of BASF Corporation.

Amine oxides having formula:

$$R^{12}R^{13}R^{14}N{=}O$$

wherein $R^{12}$, $R^{13}$ and $R^{14}$ are saturated aliphatic radicals or substituted saturated aliphatic radicals. Preferable amine oxides are those wherein $R^{12}$ is an alkyl chain of about 10 to about 20 carbon atoms and $R^{13}$ and $R^{14}$ are methyl or ethyl groups or both $R^{12}$ and $R^{13}$ are alkyl chains of about 6 to about 14 carbon atoms and $R^{14}$ is a methyl or ethyl group.

Amphoteric synthetic detergents can be broadly described as derivatives of aliphatic and tertiary amines, in which the aliphatic radical may be straight chain or branched and wherein one of the aliphatic substituents contain from about 8 to about 18 carbons and one contains an anionic water-solubilizing group, i.e., carboxy, sulpho, sulphato, phosphato or phosphono. Examples of compounds falling within this definition are sodium 3-dodecylamino propionate and sodium 2-dodecylamino propane sulfonate.

Zwitterionic synthetic detergents can be broadly described as derivatives of aliphatic quaternary ammonium, phosphonium and sulphonium compounds in which the aliphatic radical may be straight chained or branched, and wherein one of the aliphatic substituents contains from about 8 to about 18 carbon atoms and one contains an anionic water-solubilizing group, e.g., carboxy, sulpho, sulphato, phosphato or phosphono. These compounds are frequently referred to as betaines. Besides alkyl betaines, alkyl amino and alkyl amido betaines are encompassed within this invention.

Alkyl Glycosides $$R^{15}O(R^{16}O)_n(Z^1)_p$$

wherein $R^{15}$ is a monovalent organic radical (e.g., a monovalent saturated aliphatic, unsaturated aliphatic or aromatic radical such as alkyl, hydroxyalkyl, alkenyl, hydroxyalkenyl, aryl, alkylaryl, hydroxyalkylaryl, arylalkyl, alkenylaryl, arylalkenyl, etc.) containing from about 6 to about 30 (preferably from about 8 to 18 and more preferably from about 9 to about 13) carbon atoms; $R^{16}$ is a divalent hydrocarbon radical containing from 2 to about 4 carbon atoms such as ethylene, propylene or butylene (most preferably the unit $(R^{16}O)_n$ represents repeating units of ethylene oxide, propylene oxide and/or random or block combinations thereof); n is a number having an average value of from 0 to about 12; $Z^1$ represents a moiety derived from a reducing saccharide containing 5 or 6 carbon atoms (most preferably a glucose unit); and p is a number having an average value of from 0.5 to about 10 preferably from about 0.5 to about 5.

Examples of commercially available materials from Henkel Kommanditgesellschaft Aktien of Dusseldorf, Germany include APG®300, 325 and 350 with $R^{15}$ being $C_9$–$C_{11}$, n is 0 and p is 1.3, 1.6 and 1.8–2.2 respectively; APG® 500 and 550 with $R^{15}$ is $C_{12}$–$C_{13}$, n is 0 and p is 1.3 and 1.8–2.2, respectively; and APG® 600 with $R^{15}$ being $C_{12}$–$C_{14}$, n is 0 and p is 1.3.

While esters of glucose are contemplated especially, it is envisaged that corresponding materials based on other reducing sugars, such as galactose and mannose are also suitable.

The amount of glycoside surfactant, anionic surfactant and/or ethoxylated fatty alcohol surfactant will be from about 0.5 to about 30% by weight of the composition. Desirably the total amount of surfactant lies in the same range. The preferred range of surfactant is from 0.5 to 20% by weight, more preferably from 0.5 to 10% by weight.

Thickeners and Stabilizers

Thickeners are often desirable for liquid cleaning compositions. Thixotropic thickeners such as smectite clays including montmorillonite (bentonite), hectorite, saponite, and the like may be used to impart viscosity to liquid cleaning compositions. Silica, silica gel, and aluminosilicate may also be used as thickeners. Salts of polyacrylic acid (of molecular weight of from about 300,000 up to 6 million and higher), including polymers which are cross-linked may also be used alone or in combination with other thickeners. Use of clay thickeners for machine dishwashing compositions is disclosed for example in U.S. Pat. Nos. 4,431,559; 4,511,487; 4,740,327; 4,752,409. Commercially available synthetic smectite clays include Laponite supplied by Laporte Industries. Commercially available bentonite clays include Korthix H and VWH ex Combustion Engineering, Inc.; Polargel T ex American Colloid Co.; and Gelwhite clays (particularly Gelwhite GP and H) ex English China Clay Co. Polargel T is preferred as imparting a more intense white appearance to the composition than other clays. The amount of clay thickener employed in the compositions is from 0.1 to about 10%, preferably 0.5 to 5%. Use of salts of polymeric carboxylic acids is disclosed for example in UK Patent Application GB 2,164,350A, U.S. Pat. No. 4,859,358 and No.4,836,948.

For liquid formulations with a "gel" appearance and rheology, particularly if a clear gel is desired, a polymeric thickener is particularly useful. U.S. Pat. No. 4,260,528 discloses natural gums and resins for use in clear machine dishwashing detergents. Acrylic acid polymers that are cross-linked manufactured by, for example, B.F. Goodrich and sold under the trade name "Carbopol" have been found to be effective for production of clear gels, and Carbopol 940, 617 and 627, having a molecular weight of about 4,000,000 are particularly preferred for maintaining high viscosity with excellent stability over extended periods. Further suitable polymeric thickeners are described in U.S. Pat. No. 4,867,896 incorporated by reference herein.

The amount of thickener employed in the compositions is from 0 to 5%, preferably 0.5–3%.

Stabilizers and/or co-structurants such as long-chain calcium and sodium soaps and $C_{12}$ to $C_{18}$ sulfates are detailed in U.S. Pat. Nos. 3,956,158 and 4,271,030 and the use of other metal salts of long-chain soaps is detailed in U.S. Pat. No. 4,752,409. Other co-structurants include Laponite and metal oxides and their salts as described in U.S. Pat. No. 4,933,101, herein incorporated by reference. The amount of stabilizer which may be used in the liquid cleaning compositions is from about 0.01 to about 5% by weight of the composition, preferably 0.01–2%. Such stabilizers are optional in gel formulations. Co-structurants which are found especially suitable for gels include trivalent metal ions at 0.01–4% of the compositions, Laponite and/or water-soluble structuring chelants at 0.01–5%. These co-structurants are more fully described in the co-pending U.S. Pat. No. 5,141,664 by Corring et al., filed Dec. 30, 1987, which application is hereby incorporated by reference.

Filler

An inert filler material which is water-soluble may also be present in cleaning compositions. This material should not precipitate calcium or magnesium ions at the filler use level. Suitable for this purpose are organic or inorganic compounds. Organic fillers include sucrose esters and urea. Representative inorganic fillers include sodium sulfate, sodium chloride and potassium chloride. A preferred filler is sodium sulfate. Its concentration may range from 0% to 40%, preferably from about 2% to about 20% by weight of the cleaning composition.

Defoamer

The formulations of the cleaning composition comprising surfactant may further include a defoamer. Suitable defoamers include mono-and distearyl acid phosphate, silicone oil and mineral oil. Even if the cleaning composition has only defoaming surfactant, the defoamer assists to minimize foam which food soils can generate. The compositions may include 0.02 to 2% by weight of defoamer, or preferably 0.05–1.0%. Preferred antifoam systems are described in Angevaare et al.; U.S. Ser. No. 08/539,923, filed Oct. 6, 1995, now U.S. Pat. No. 5,705,465 herein incorporated by reference.

Enzymes

Enzymes capable of facilitating the removal of soils from a substrate may also be present in an amount of up to about 10% by wt., preferably 1 to about 5 wt. %. Such enzymes include proteases (e.g., Alcalase®), Savinase® and Esperase® from Novo Industries ANS and Purafect OxP, ex. Genencor), amylases (e.g., Termamyl® and Duramyl® from Novo Industries and Purafect OxAm, ex. Genencor) and lipases (e.g. Lipolase® from Novo Industries).

Silicates

If silicates are present in the compositions of the invention, they should be in an amount to provide neutral or low alkalinity (less than pH 10) of the composition. Preferred amounts of silicates present should be from less than to about 50%, most preferably 1 to 20 wt. %. Especially preferred is sodium silicate in a ratio of $SiO_2$:$Na_2$ up from about 1.0 to about 3.3, preferably from about 2 to about 3.2.

Optional Ingredients

Minor amounts of various other components may be present in the cleaning composition. These include bleach scavengers including but not limited to sodium bisulfite, sodium perborate, reducing sugars, and short chain alcohols; solvents and hydrotropes such as ethanol, isopropanol and xylene sulfonates; enzyme stabilizing agents; soil suspending agents; antiredeposition agents; anti-corrosion agents, such as benzotriazole and isocyanuric acid described in Angevaare, U.S. Pat. No. 5,374,369; ingredients to enhance decor care such as certain aluminum salts described in U.S. Ser. No. 08/444,502 filed May 19, 1995, now U.S. Pat. Nos. 5,698,506, and Ser. No. 08/444,503, filed May 19, 1995, now U.S. Pat. No. 5,624,892 herein incorporated by reference; colorants; perfumes; and other functional additives.

The following examples will serve to distinguish this invention from the prior art and illustrate its embodiments more fully. Unless otherwise indicated, all parts, percentages and proportions referred to are by weights.

EXAMPLE 1

A wet cake of phthalimidoperhexanoic acid (PAP) having an average moisture content of 21.5% was granulated with a partially neutralized acrylate-maleate copolymer (Sokalan CP-45® supplied by BASF), an exotherm control compound or compounds in the form of a powder, and 1.0% of a sodium salt of a secondary alkanesulfonate (Hostapur SAS-60® supplied by Hoechst Celanese as a 60% aqueous solution) in different ratios to produce the granules listed in Table 1. The average temperature of the granulation mixtures was 17° C. The resultant granules were dried at 55° C. and then sieved to obtain a relatively high yield of the desired particle cut size of 840 microns to 2000 microns.

TABLE 1

| | Batch Number | | | |
|---|---|---|---|---|
| Compound | 1 | 2 | 3 | 4 |
| PAP | 69.5 | 78.5 | 83.5 | 73.5 |
| Sokalan CP-45 | 10.0 | 10.0 | 5.0 | 5.0 |
| Citric Acid Monohydrate | — | — | 10.0 | 10.0 |
| Boric Acid | 19.0 | 10.0 | — | 10.0 |
| Hostapur SAS-60 | 1.0 | 1.0 | 1.0 | 1.0 |
| Moisture | 0.5 | 0.5 | 0.5 | 0.5 |
| Available Oxygen | 4.03 | 4.45 | 4.72 | 4.16 |

EXAMPLE 2

The granules produced in Example 1. were dissolved in a standardized agitated beaker test where the temperature is ramped from 25° C. to 55° C. at a controlled rate over a 20 minute span. The dissolution rates of the granules produced in Example 1. were determined by an HPLC method and are listed in Table 2. as the percent of oxygen agent dissolution with time. The results indicate that more than 80% of the peracid has dissolved within the first minute for granules produced with citric acid monohydrate as the sole control agent. All granules formulated with boric acid as the exotherm control reagent require approximately 5 minutes to reach this level of dissolution.

TABLE 2

Dissolution Rate of Peracid Granules

| Batch | % Dissolution | | | | | |
|---|---|---|---|---|---|---|
| # | 1 min. | 2 min. | 3 min. | 4 min. | 5 min. | 8 min. |
| 1 | 25 | 56 | 71 | 78 | 84 | 88 |
| 2 | 32 | 50 | 62 | 72 | 83 | 98 |
| 3 | 81 | 87 | 93 | 96 | 99 | 100 |
| 4 | 25 | 42 | 56 | 71 | 81 | 98 |

EXAMPLE 3

The explosive properties and heat resistance properties of granules and materials containing phthalimidoperhexanoic acid were tested to determine the degree of safety these materials offered to those handling the materials. The compositions of the granules and materials are listed in Table 3. Materials tested include 1.) dry phthalimidoperhexanoicacid (PAP), 2.) moist PAP crystals (PAP wet cake), 3.) boric acid containing granules, and 4.) citric acid containing granules.

TABLE 3

| | Batch Number | | | |
|---|---|---|---|---|
| Compound | 1 | 2 | 3 | 4 |
| PAP | 100 | 77.1 | 74.6 | 83.5 |
| Sokalan CP-45 | | | 3.0 | 5.0 |
| Citric Acid Monohydrate | | | — | 10.0 |
| Boric Acid | | | 21.4 | — |

TABLE 3-continued

| | Batch Number | | | |
|---|---|---|---|---|
| Compound | 1 | 2 | 3 | 4 |
| Hostapur SAS-60 | | | 0.5 | 1.0 |
| Moisture | | 22.9 | 0.5 | 0.5 |
| Available Oxygen | 5.7 | 4.4 | 4.3 | 4.72 |

All tests were conducted in accordance with United Nations Transport of Dangerous Goods, Tests and Criteria, second edition (1990). Results for the materials listed in Table 3 are listed in Table 4.

TABLE 4

| | Test Result | | | |
|---|---|---|---|---|
| UN Test | 1 | 2 | 3 | 4 |
| Gap Test for Organic Peroxides Test A.3 | Fail | Pass | Pass | Pass |
| Time/Pressure Test - Test C.1 | Fail | Pass | Pass | Pass |
| Deflagration Test - Test C.2 | Fail | Pass | Pass | Pass |
| Dutch Pressure Vessel Test - Test E.2 | N/A | Low | Pass | Pass |
| United States Pressure Vessel Test - Test E.3 | N/A | Low | Pass | Pass |
| Modified Trauzl Block Test | Fail | Pass | Pass | Pass |

N/A—Not Available

PAP granules produced with both citric acid monohydrate and boric acid as exotherm control agents pass all the organic peroxide safety tests outlined by United Nations procedures which they were subjected to.

EXAMPLE 4

Granules from Example 1 containing PAP and either boric acid (Batch Number 1) or citric acid (Batch Number 4) as exotherm agents were evaluated for bleaching performance from both liquid and powder bases. The liquid base contained potassium tripolyphosphate, amylase, protease, low foaming nonionic surfactant and was buffered at pH 8.5 with glycerol/borax. The powder base contained citrate and acrylate/maleate builder, amylase, protease, low foaming nonionic surfactant and was buffered with bicarbonate. The wash pH for both powder and liquid was 8.5.

The removal of egg soil and cream of wheat soil from plates, as well as removal of tannin stain from tea cups stained four times with tea was evaluated in Bauknecht (Rapid Cycle) and Bosch (Quick Cycle) dishwashing machines. Water hardness was 250 ppm (calcium to magnesium ratio of 4:1) with 40g of a mixture of butter and dried milk added in each run. The level of PAP in the wash was 6.6 ppm AvOx in all runs. The results are shown in Table 5.

TABLE 5

| Base | Machine | Granule | Egg* | Wheat* | Tea** |
|---|---|---|---|---|---|
| Liquid | Bauknecht | Boric Acid | 95 | 20 | 1.5 |
| Liquid | Bauknecht | Citric Acid | 100 | 10 | 0.25 |
| Powder | Bosch | Boric Acid | 50 | 5 | 2.5 |
| Powder | Bosch | Citric Acid | 45 | 5 | 1.5 |

*Percent soil remaining
**On scale of 0 (no stain) to 5.0 (heavily stained)

The results clearly show that the PAP granules containing citric acid deliver superior bleaching to those containing boric acid without any significant negatives on either starch or egg soils.

What is claimed:

1. A bleaching granule containing an exotherm control agent comprising:

a) an effective amount of a peracid compound;

b) citric acid monohydrate present in a ratio of 1:2 to 15:1 peracid compound to citric acid monohydrate; and c) a polymeric agglomerating agent present in a weight ratio of the agglomerating agent to the peracid compound in a range of from 1:2 to 1:50, and the peracid compound, the citric acid monohydrate and the agglomerating agent are combined to form a mixture which is agglomerated together to form a uniformly dispersed bleaching granule, wherein the citric acid monohydrate dehydrates at a temperature around that at which the peracid starts to self-heat so as to function as an exotherm control agent.

2. A granule according to claim 1 wherein the peracid compound is selected from the group consisting of an organic peroxy acid, a diacyl peroxide, and mixtures thereof.

3. A granule according to claim 2 wherein the organic peroxy acid is a monoperoxy acid.

4. A granule according to claim 1 wherein the citric acid monohydrate dehydrates at about 70° C. to about 75° C.

5. An automatic dishwashing detergent composition containing an exotherm control agent comprising:

a) from about 0.1 to about 15 wt. % bleaching granules comprising (i) an effective amount of a peracid compound;

(ii) citric acid monohydrate present in a ratio of 1:2 to 15:1 peracid compound to citric acid monohydrate;

(iii) a polymeric agglomerating agent present in a weight ratio of the agglomerating agent to the peracid compound in a range of from 1:2 to 1:50 the peracid compound, the citric acid monohydrate and the agglomerating agent are combined to form a mixture which is agglomerated together to form a uniformly dispersed bleaching granule, wherein the citric acid monohydrate dehydrates at a temperature around that at which the peracid starts to self-heat so as to function as an exotherm control agent; and b) 1 to about 75 wt. % of a builder.

6. The composition according to claim 5 wherein the peracid compound is selected from the group consisting of an organic peroxy acid, a diacyl peroxide, and mixtures thereof.

7. The composition according to claim 6 wherein the organic peroxy acid is a monoperoxy acid.

8. The composition according to claim 5 further comprising a surfactant in an amount of from about 0.5 to about 20 wt. %.

9. The composition according to claim 5 further comprising 0.1 to 5 wt. % of an enzyme.

10. The detergent composition according to claim 5 wherein the citric acid monohydrate dehydrates at about 70° C. to about 75° C.

11. A method of preparing a bleaching granules containing an exotherm control agent comprising the steps of:

a) selecting an effective amount of a peracid compound;

b) agglomerating a combined mixture of the peracid compound, citric acid monohydrate and a polymeric agglomerating agent such that the compounds are present in a ratio of the peracid compound to the citric acid monohydrate of 1:2 to 15:1 and the agglomerating agent to the peracid compound in a range of from 1:2 to 1:50, to form uniformly dispersed bleaching granules, wherein the citric acid monohydrate dehydrates at a temperature around that at which the peracid starts to self-heat so as to function as an exotherm control agent.

12. A method according to claim 11 wherein the peracid compound, the citric acid monohydrate and the agglomerating agent are agglomerated together to form a bleaching granule which has an acidic environment within the granule and which is devoid of metal ions in order to stabilize the peracid compound and to prevent exothermic decomposition of the peracid compound in the granule.

13. A method according to claim 11 wherein the peracid is an organic monoperoxy acid.

14. The method according to claim 11 wherein the citric acid monohydrate dehydrates at about 70° C. to about 75° C.

15. A method of dissolving a bleaching granule containing an exotherm control agent in automatic dishwashing machines comprising the steps of:

a) introducing a bleaching granule in an automatic dishwashing machine comprising:

(i) an effective amount of a peracid compound;

(ii) citric acid monohydrate present in a ratio of 1:2 to 15:1 peracid compound to citric acid monohydrate;

and (iii) a polymeric agglomerating agent present in a weight ratio of the agglomerating agent to the peracid compound in a range of from 1:2 to 1:50, and the peracid compound, the citric acid monohydrate and the agglomerating agent are combined to form a mixture which is agglomerated together to form a uniformly dispersed bleaching granule, wherein the citric acid monohydrate dehydrates at a temperature around that at which the peracid starts to self-heat so as to function as an exotherm control agent; and b) dissolving the granules in a wash cycle of a dishwashing machine to provide effective bleaching.

16. A method according to claim 15 wherein the peracid compound, the citric acid monohydrate and the agglomerating agent and agglomerated together to form a bleaching granule which has an acidic environment within the granule and which is devoid of metal ions in order to stabilize the peracid compound and to prevent exothermic decomposition of the peracid compound in the granule.

* * * * *